US007220147B2

(12) United States Patent
Fujita et al.

(10) Patent No.: US 7,220,147 B2
(45) Date of Patent: May 22, 2007

(54) MICROCONNECTOR AND MANUFACTURING METHOD OF SOCKET THEREFOR

(75) Inventors: Hiroyuki Fujita, Tokyo (JP); Hiroto Mochizuki, Tokyo (JP)

(73) Assignee: Taiko Denki Co., Ltd., Tokyo (JP)

( * ) Notice: Subject to any disclaimer, the term of this patent is extended or adjusted under 35 U.S.C. 154(b) by 0 days.

(21) Appl. No.: 10/541,237

(22) PCT Filed: Jan. 26, 2004

(86) PCT No.: PCT/JP2004/000650

§ 371 (c)(1),
(2), (4) Date: Jul. 1, 2005

(87) PCT Pub. No.: WO2004/068649

PCT Pub. Date: Aug. 12, 2004

(65) Prior Publication Data

US 2006/0057895 A1 Mar. 16, 2006

(30) Foreign Application Priority Data

Jan. 27, 2003 (JP) ..... 2003-018059
Jan. 27, 2003 (JP) ..... 2003-018060

(51) Int. Cl.
*H01R 24/00* (2006.01)

(52) U.S. Cl. ..... 439/630

(58) Field of Classification Search ..... 439/630, 439/632, 61–66, 67, 593
See application file for complete search history.

(56) References Cited

U.S. PATENT DOCUMENTS 5,378,159 A * 1/1995 Renn ..... 439/59
6,478,627 B2 * 11/2002 Farnworth et al. ..... 439/632
2003/0203678 A1 * 10/2003 Farnworth et al. ..... 439/630

FOREIGN PATENT DOCUMENTS

| | | |
|---|---|---|
| JP | A 09-69678 | 3/1997 |
| JP | A 11-54175 | 2/1999 |
| JP | A 2001-332344 | 11/2001 |
| JP | A 2002-246117 | 8/2002 |

* cited by examiner

*Primary Examiner*—J. F. Duverne
(74) *Attorney, Agent, or Firm*—Oliff & Berridge, PLC

(57) ABSTRACT

A microconnector in which elastic contact force is improved and a manufacturing method of a socket therefore, are provided.

The microconnector includes:

the socket 10 in which plural cantilever terminal blocks 14 having pressure receiving parts 16 are integrally formed on a board 11 made of single crystal silicon, and socket leads 15 are disposed on the terminal blocks 14; and a plug 20 in which plug leads 21 corresponding to the socket leads 15 are provided on a plug board 23.

The manufacturing method of the socket 10 includes:

a step of applying a resist to one surface of the board 11;

a step of patterning the terminal blocks 14 by photolithography;

a step of performing anisotropic etching to form the terminal blocks 14 to predetermined heights while a bottom is made to remain;

a step of applying a resist to the other surface of the board 11;

a step of patterning the pressure receiving parts 16 by photolithography; and a step of performing isotropic etching to remove the bottom.

3 Claims, 10 Drawing Sheets

MICROCONNECTOR AND MANUFACTURING METHOD OF SOCKET THEREFOR

TECHNICAL FIELD

The present invention relates to an electric connector, and particularly to an electric connector in which a pitch between adjacent contact terminals is very small, that is, a microconnector and a manufacturing method of a socket therefor.

BACKGROUND ART

As a conventional technology, there is an example of a microconnector that is made small in a similar shape to an electric connecter in which a pitch between adjacent contact terminals is of the order of a few millimeters to several hundred micrometers. In this conventional microconnector, plural tuning-fork type contact terminals are prepared on a female side, that is, on a board of a socket, and plural rod-like contact terminals are provided on a male side, that is, on a board of a plug. The rod-like contact terminals enter between the tuning-fork type contact terminals, and the rod-like contact terminals are held by the spring forces of the tuning-fork type contact terminals, so that electrical connection of both is achieved. For example, JP-A-2002-246117 (FIG. 1) discloses this example.

However, in the above microconnector, when the distance between the adjacent contact terminals, that is, the pitch between the terminals becomes as fine as a few hundred to several tens micrometers, the contact terminal itself naturally becomes fine and thin, and in the contact terminal made of metal such as phosphor bronze which is widely used in a general electric connector, the spring force becomes insufficient, and the electrical connection between both the contact terminals becomes fragile. In other words, in the microconnector, the improvement of this spring force is one of subjects to be solved.

Then, a task of the invention is to provide a microconnector in which spring force of the contact terminal is improved and a manufacturing method of a socket therefor.

DISCLOSURE OF THE INVENTION

In order to solve the above task, according to the invention, a microconnector includes a socket in which plural cantilever terminal blocks having pressure receiving parts are integrally formed on a board made of single crystal silicon, and socket leads are disposed on the terminal blocks, and a plug in which plug leads corresponding to the socket leads are provided on a plug board. By this, since the silicon excellent in spring characteristics is used for the board of the socket, and the terminal block is made such that the shape of an elastic contact part with the lead is the cantilever shape, the spring characteristics of the silicon are efficiently used. Besides, since the pressure receiving part is provided on the terminal block and the socket lead is provided, the elastic contact between the socket lead and the plug lead becomes firm, and the electrical connection between both the leads can be made reliable. Further, since the single crystal silicon is adopted for the board of the socket, a well-known micromachining technique is efficiently used, and fine processing can be precisely and easily performed. As a result, the microconnector with a narrower pitch between contact terminals and low height can be realized.

Besides, a microconnector includes a socket in which on a board made of single crystal silicon, plural cantilever terminal blocks having free ends with pressure receiving parts in their vicinities and fixed ends continuous with the board are integrally formed, socket leads extending from the fixed ends to the free ends are disposed on upper surfaces of the terminal blocks, a guide pin receiving part and a guide groove continuous with the guide pin receiving part and formed in parallel to the terminal blocks are formed, and a housing covering the free ends and forming a receiving gap part to receive a plug in cooperation with the board is mounted, and the plug in which plug leads corresponding to the socket leads and a guide pin corresponding to the guide groove are provided on a plug board, and consequently, since the silicon excellent in spring characteristics is used for the board, and the terminal block is made such that the shape of an elastic contact part with the lead is the cantilever shape, the spring characteristics of the silicon are efficiently used. Besides, since the pressure receiving part is provided on the terminal block and the socket lead is provided, the elastic contact between the socket lead and the plug lead becomes firm, and the electrical connection between both the leads can be made reliable. Further, since the single crystal silicon is adopted for the board of the socket, a well-known micromachining technique is efficiently used, and fine processing can be precisely and easily performed. As a result, the microconnector with a narrower pitch between contact terminals and low height can be realized. Further, since the guide pin receiving part and the guide groove continuous with the guide pin receiving part and formed in parallel to the terminal blocks are formed, and the guide pin corresponding to the guide groove is provided on the plug board, the mutual positioning of the socket lead and the plug lead can be certainly performed with high accuracy.

Besides, when the microconnector is made such that the free ends of the plural cantilever terminal blocks are directed to inside of the board, smooth insertion of the plug is made possible, and the treatment of the terminals of the socket leads becomes easy.

Besides, when the microconnector is made such that the terminal blocks in which the fixed ends are continuous with the board at an insertion side of the plug and the terminal blocks in which the fixed ends are continuous with the board at an opposite side thereto are provided, and the pressure receiving parts provided in the vicinities of the free ends are arranged in a staggered manner, since the pressure receiving parts are provided in the staggered manner, the terminal density can be further raised.

Further, in order to solve the task of obtaining the manufacturing method of the socket of the microconnector in which elastic force is improved, the manufacturing method of the invention is a manufacturing method of a socket using a micromachining technique in which a board is hollowed out in a vertical direction to form cantilever terminal blocks, pressure receiving stands slightly higher than the terminal blocks are formed on the terminal blocks, and the terminal blocks and the pressure receiving stands are smoothly connected.

Then, according to the invention, a manufacturing method of a socket for a microconnector in which on a board made of single crystal silicon, plural cantilever terminal blocks including free ends having pressure receiving parts in their vicinities and fixed ends continuous with the board are integrally formed, the manufacturing method of the socket for the microconnector including a step of applying a resist to one surface of the board, a step of patterning the terminal blocks by photolithography, a step of performing anisotropic etching to form the terminal blocks to predetermined heights while a bottom is made to remain, a step of applying a resist to the other surface of the board, a step of patterning the pressure receiving parts by photolithography, and a step of performing isotropic etching to remove the bottom.

By this, since the silicon excellent in spring characteristics is used for the board, and the terminal block is made such that the shape of an elastic part is the cantilever shape, the spring characteristics are efficiently used, and the microconnector in which the electrical connection between both the leads is made reliable is obtained. As the manufacturing method thereof, the single crystal silicon is adopted for the board, and the anisotropic etching technique and the isotropic etching technique are skillfully combined and used, and accordingly, the fine processing can be precisely and easily performed. Especially, when the pressure receiving part is formed into a trapezoid so as to smoothly connect the pressure receiving part and an after-mentioned socket lead, after the board is processed by the anisotropic etching in the vertical direction to a predetermined depth, the back side is subjected to the isotropic etching to form the trapezoid while the etching remainder is removed. Thus, a mechanical processing step such as polishing is removed, and the very delicate fine processing can be provided clean and inexpensively.

Besides, according to the invention, a manufacturing method of a socket for a microconnector in which on a board made of single crystal silicon, plural cantilever terminal blocks including free ends having pressure receiving parts in their vicinities and fixed ends continuous with the board, and a guide pin receiving part and a guide groove continuous with the guide pin receiving part and formed in parallel to the terminal blocks are integrally formed, the manufacturing method of the socket for the microconnector including a step of applying a resist to one surface of the board, a step of patterning the terminal blocks, the guide pin receiving part and the guide groove by photolithography, a step of performing anisotropic etching to form the terminal blocks to predetermined heights while a bottom is made to remain and to form hollows of the guide pin receiving part and the guide groove, a step of applying a resist to the other surface of the board, a step of patterning the pressure receiving parts by photolithography, and a step of performing isotropic etching to remove the bottom.

By this, since the silicon excellent in spring characteristics is used for the board, and the terminal block is made such that the shape of an elastic part is the cantilever shape, the spring characteristics are efficiently used, and the microconnector in which the electrical connection between both the leads is made reliable is obtained. As the manufacturing method thereof, the single crystal silicon is adopted for the board, and the anisotropic etching technique and the isotropic etching technique are skillfully combined and used, and accordingly, the fine processing can be precisely and easily performed. Especially, when the pressure receiving part is formed into a trapezoid so as to smoothly connect the pressure receiving part and an after-mentioned socket lead, after the board is processed by the anisotropic etching in the vertical direction to a predetermined depth, the back side is subjected to the isotropic etching to form the trapezoid while the etching remainder is removed. Thus, a mechanical processing step such as polishing is removed, and the very delicate fine processing can be provided clean and inexpensively. Further, since the guide pin receiving part and the guide groove can be formed simultaneously with the terminal blocks and integrally therewith, the contact position accuracy important for the fine microconnector can be certainly kept.

In the invention, attention is paid to the fact that the spring characteristics of silicon are more excellent than normally used metal such as phosphor bronze, and even if it is made fine, its characteristics are not lost, and in this silicon, fine processing of the single crystal silicon can be very precisely and easily performed by a micromachining technique. The board of the socket is made of the single crystal silicon, the cantilever terminal blocks having the pressure receiving stands are formed there by the micromachining technique, and the socket leads are further disposed thereon, and when the plug leads are pressed to the pressure receiving stands, the cantilever terminal blocks are allowed to be deflected by the press forces to create the spring forces, and the repulsive forces are obtained, and the microconnector most suitable for bringing both the leads into firm elastic contact and the manufacturing method of the socket therefor are obtained. That is, the part of the board is made the cantilever terminal block, and itself is made to have the spring characteristics.

Incidentally, Table 1 shows mechanical characteristics of phosphor bronze used for tuning-fork type contact terminals of a general electric connector and silicon.

TABLE 1

| contact terminal material | Young's modulus | yield (strength) | remarks |
|---|---|---|---|
| phosphor bronze | 110 GPa | 400 MPa | alloy number: C5191 |
| silicon | 190 GPa | 7000 MPa | Si single crystal: 110 plane |

Since Young's modulus of silicon is 1.7 times as large as phosphor bronze widely used for a terminal of a connector, even when it is made fine, its hardness is not lost, and suitable resistance to deformation can be maintained (when the hardness is lost and deformation becomes easy, even if the plug comes in strong contact, it is deformed and escapes, and strong press contact can not be obtained). At the same time, since the yield point strength of silicon is 17 times as high as phosphor bronze, even if large force is applied, plastic deformation is hard to cause, and even if it is made fine, its large elastic force is not lost (when the plug comes in strong contact, pushing back is surely caused without causing plastic deformation, and strong press contact can be obtained). Thus, in the case where silicon is made to function as a spring, excellent spring characteristics of suitable hardness and high elastic force can be exhibited.

BRIEF DESCRIPTION OF THE DRAWINGS

FIGS. 1A to 1C are schematic perspective view of a socket of a microconnector as an embodiment of the invention when viewed from above, in which FIG. 1A shows the whole socket, FIG. 1B shows a terminal block separated and enlarged, and FIG. 1C shows only a board portion in which a housing is removed.

FIGS. 5A to 5V are explanatory views of a manufacturing method of the socket of the embodiment shown in FIG. 1, in which FIGS. 5A to 5P show a manufacturing method of a board, FIG. 5V is a perspective view of the completion state of the socket in which the board and the housing are assembled.

BEST MODE FOR CARRYING OUT THE INVENTION

For the purpose of describing the invention in more detail, a description will be made with reference to attached drawings.

Figure 1A:
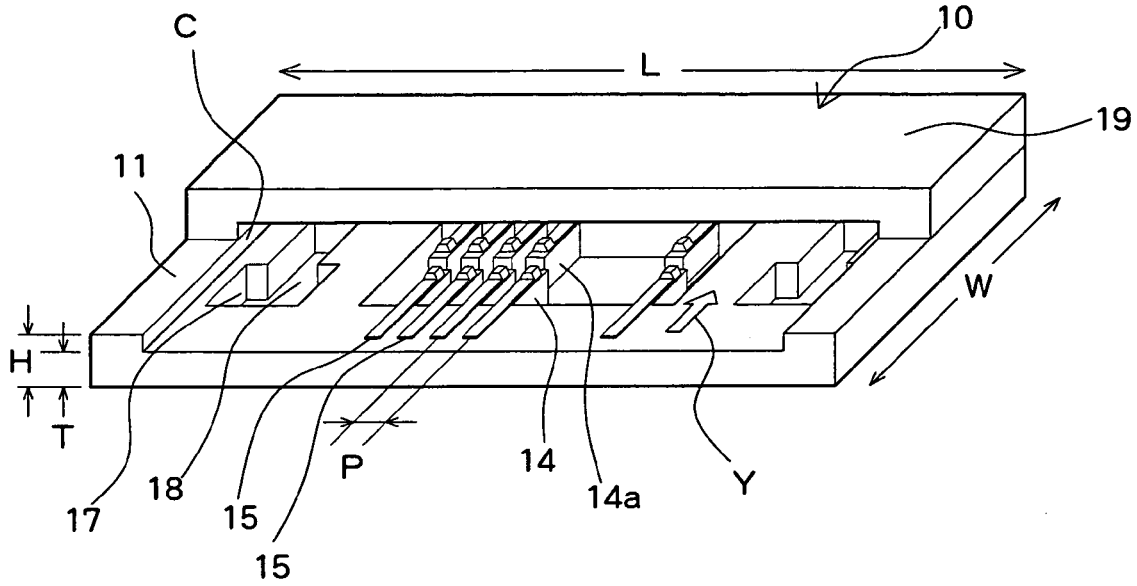

FIG. 1A is a perspective view when viewed from a female side of a microconnector as an embodiment of the invention, that is, from an upper surface side of a socket 10, and a board 11 thereof is made of single crystal silicon having the (110) crystal plane, and L (whole length)×W (whole width)×H (whole height) thereof are, for example, 10 millimeters×6 millimeters×0.2 millimeters (board height), and the height of the whole socket is 0.5 millimeters and it is very small. In plural terminal blocks 14 formed into cantilever shapes, their free ends 12 exist inside the board 11, fixed ends 13 are continuous with the board 11,and the respective terminal blocks 14 are formed integrally with the board. That is, the terminal blocks 14 are formed by removing unnecessary portions of the board 11. Incidentally, a pitch P between the adjacent terminal blocks 14 is as fine as 200 to 40 micrometers. A socket lead 15 extending from the fixed end 13 to the free end 12 is disposed on the upper surface of the terminal block 14, and a pressure receiving part 16 (in this example, trapezoidal shape of square, see FIG. 1B) slightly raised by a height t is formed in the vicinity of the free end 12.

Figure 1B:
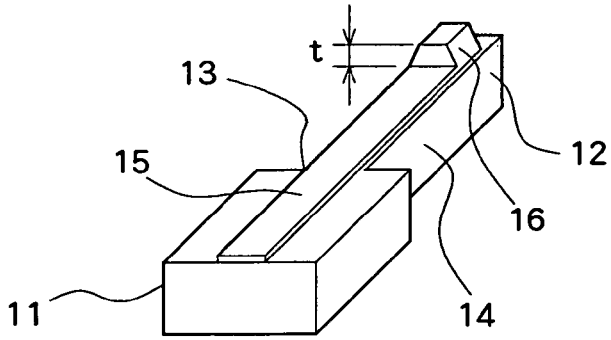
Figure 1C:
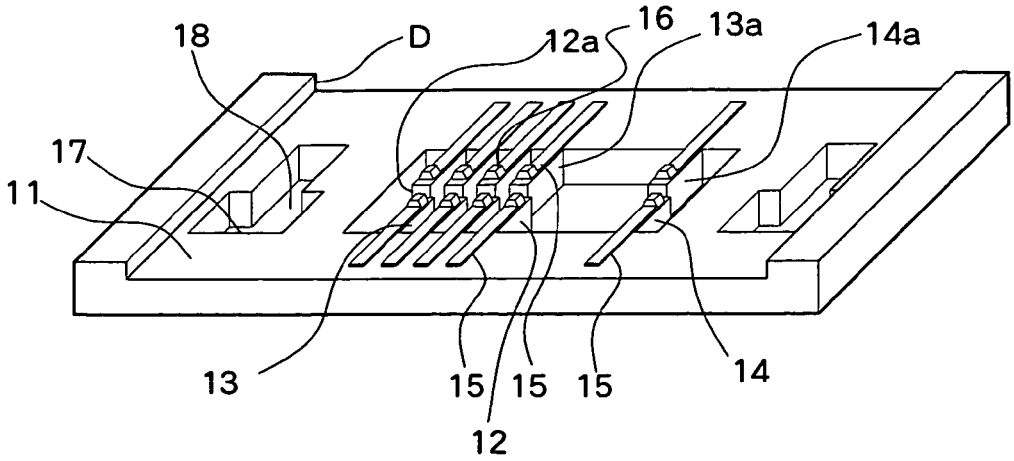

Incidentally, an arrow Y in the drawing indicates an insertion direction of an after-mentioned plug 20, and as is apparent from FIG. 1C, in this embodiment, there are provided the terminal blocks 14 with the fixed ends 13 continuous with the board 11 at the insertion side of the plug 20 and terminal blocks 14*a* with fixed ends 13*a* continuous with the opposite side board 11, and the pressure receiving parts 16 provided in the vicinities of the free ends 12 and 12*a* are disposed in a staggered manner to double the density between terminals. Of course, not the staggered arrangement as stated above, a structure in which the density between the terminal blocks 14 is increased can also be adopted. In this case, the length of the terminal block can be made longer as the need arises.

Further, as is apparent from FIG. 1B, in this embodiment, the pressure receiving part 16 is trapezoidal, the connection from the socket lead 15 to the pressure receiving part 16 is smooth, and an operation that an after-mentioned plug lead 21 slides on the socket lead 15 and mounts on the pressure receiving part 16 can be smoothly performed. In addition, a stepped part D (FIG. 1C) forms a bump for forming an after-mentioned receiving gap part C. This bump can be eliminated from the board 11 by increasing the height of a stepped part G of an after-mentioned housing 19.

Besides, a guide groove 18 is provided on the board 11 in parallel to the terminal block 14, and a guide pin receiving part 17 is continuous with the guide groove 18.

Each of the terminal block 14, the guide pin receiving part 17, and the guide groove 18 has a thickness T slightly thinner than the whole height H of the board 11, and is formed by hollowing out the board 11.

Further, the housing 19 made of silicon is mounted on the board 11 so as to form the receiving gap part C which receives and holds an after-mentioned male side of the connector, that is, the plug 20 in cooperation with the stepped part D of the board 11, and so as to be capable of covering the pressure receiving parts 16 of the terminal blocks 14.

Figure 2:
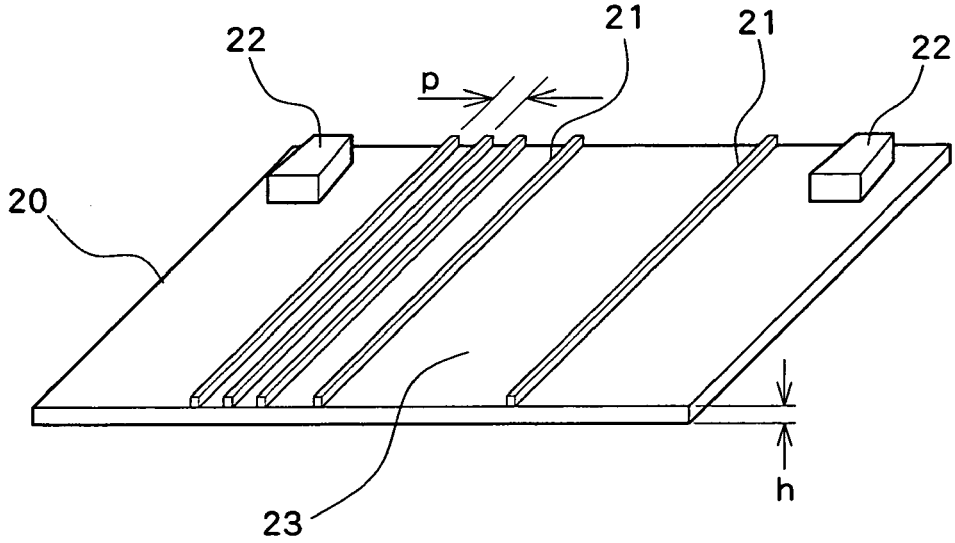
FIG. 2 is a schematic perspective view of a plug of the microconnector corresponding to the socket of FIG. 1 when viewed from back.

FIG. 2 is a perspective view of the plug 20 when viewed from the back side, and plural plug leads 21 corresponding to the socket leads 15 or the pressure receiving parts 16 and a guide pin 22 corresponding to the guide groove 18 are formed on a plug board 23. Incidentally, a pitch p of the plug leads 21 is almost half of the pitch P of the socket leads 15 according to the fact that the pressure receiving parts 16 are formed in the staggered manner. The thickness h of the plug board 23 is made to correspond to the height of the receiving gap part C. The guide pin 22 has a tapered shape, and ensures the smoothness of an operation when it is advanced to the guide groove 18 and positioning is performed after being loosely fitted in the guide pin receiving part 17 from above.

Incidentally, although the plug board 23 may be made of single crystal silicon similarly to the board 11 of the socket 10, in this embodiment, since the structure is made such that it is unnecessary to etch the plug board 23, glass, glass epoxy or the like can be adopted.

Besides, the surfaces of the board 11 and the plug board 23 are insulated by silicon oxide ($SiO_2$) or the like, the socket leads 15 and the plug leads 21 are respectively disposed thereon, and preparations are made for an unexpected short circuit and the like.

Next, the function of this microconnector will be described.

Figure 3:
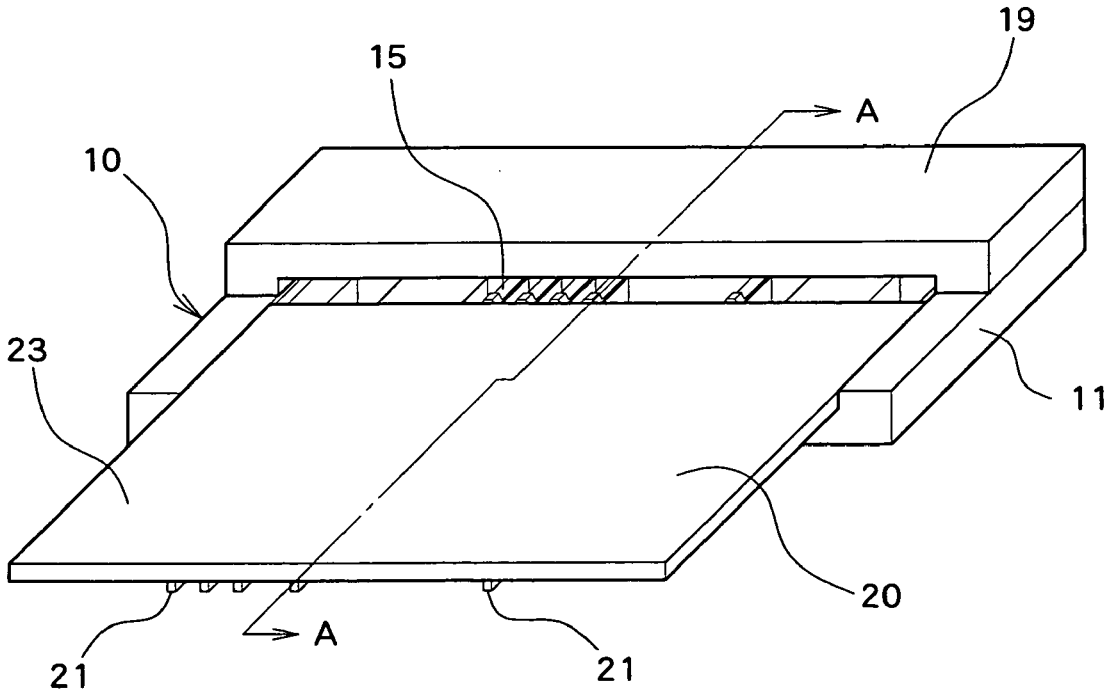
FIG. 3 is a schematic perspective view of the connector for explaining a connecting procedure of the socket and the plug shown in FIGS. 1 and 2.

As the connector, in order to connect the socket 10 and the plug 20, first, the upper and lower surfaces of the plug 20 shown in FIG. 2 are reversed, and as shown in FIG. 3, the guide pin 22 is loosely fitted in the guide pin receiving part 17 of the socket 10 shown in FIG. 1 to perform rough positioning, and subsequently, the plug 20 is pushed in the direction indicated by the arrow Y of FIG. 1, and while the guide pin 22 is made to advance into the guide groove 18, most of the plug 20 enters the receiving gap part C of the socket 10, and the combination of the socket and the plug with fine positioning is achieved. That is, the plug leads 21 mount on the predetermined pressure receiving parts 16, and the electrical connection of both the leads 15 and 21 is completed.

Figure 4:
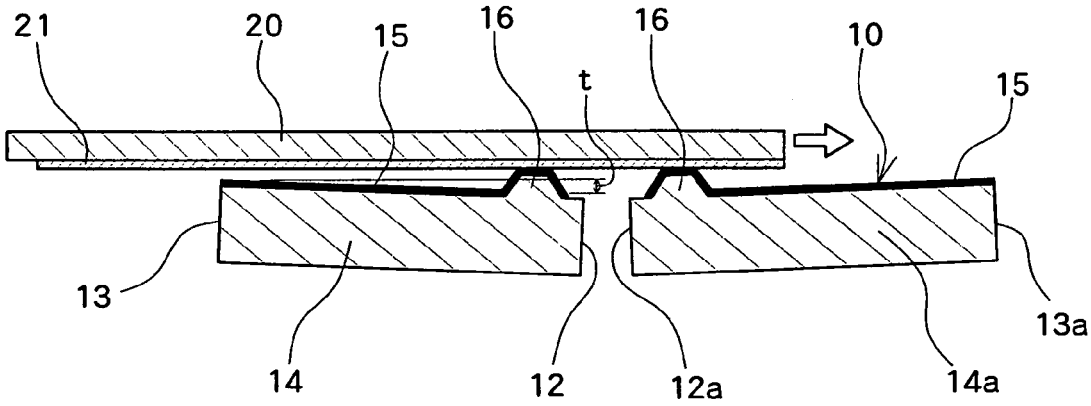
FIG. 4 is a modeled explanatory view of an A—A section of FIG. 3.

At this time, as shown in FIG. 4, since the plug lead 21 mounts on the pressure receiving part 16 and presses it, the pressure receiving part 16 is displaced downward by the height t, and the terminal block 14 is distorted. However, since the board 11 is made of silicon and the terminal block 14 exerts excellent spring force, the elastic contact between the plug lead 21 and the pressure receiving part 16 can be made reliable.

Next, an example of a manufacturing method of a microconnector based on the invention applied to the above embodiment will be described.

First, means for forming the plug leads 21 and the guide pin 22 on the plug board 23 of the plug 20 will be mentioned. This adopts deposition of metal by well-known electroplating or electroless plating, that is, an electroforming technique. However, a technique other than that can also be adopted.

Figure 5A:
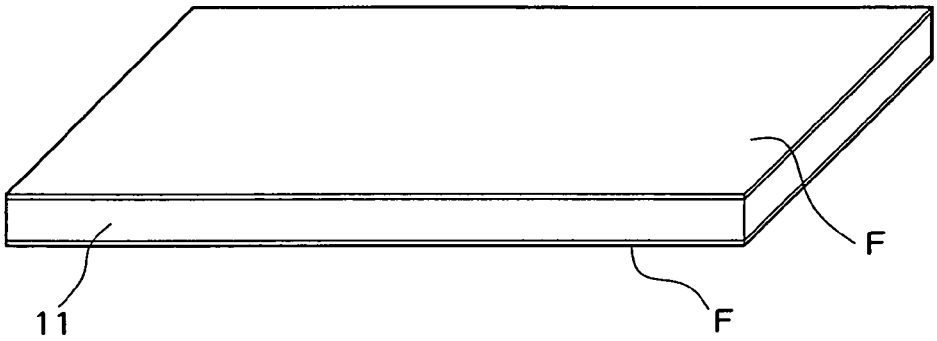
Figure 5B:
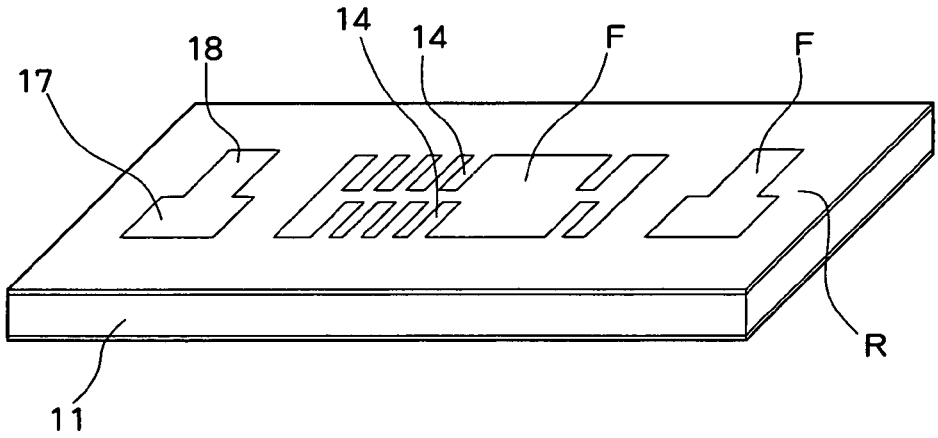
Figure 5C:
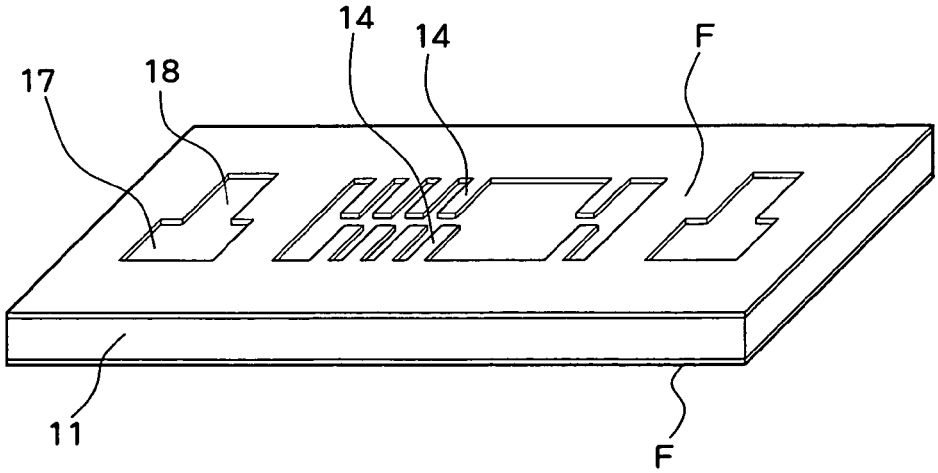
Figure 5D:
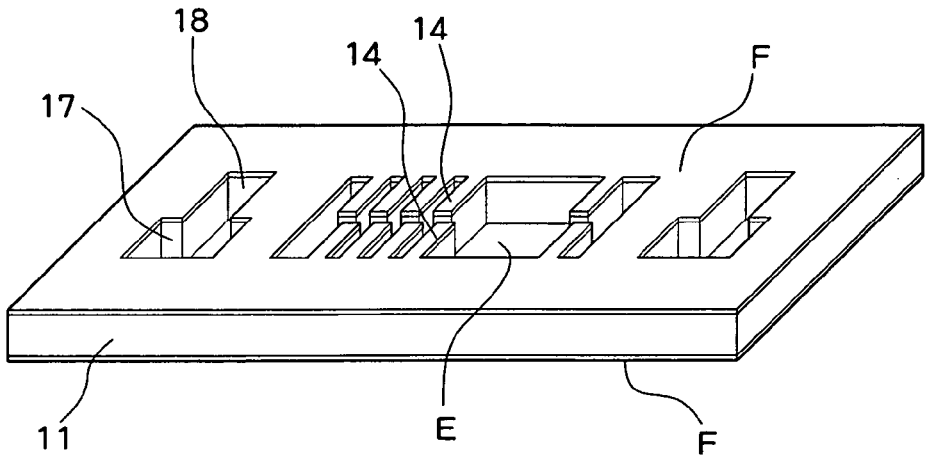
Figure 5E:
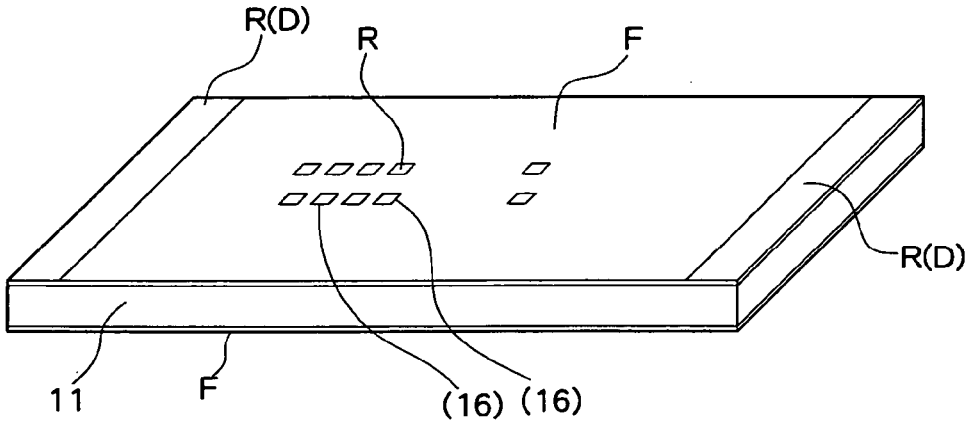
Figure 5F:
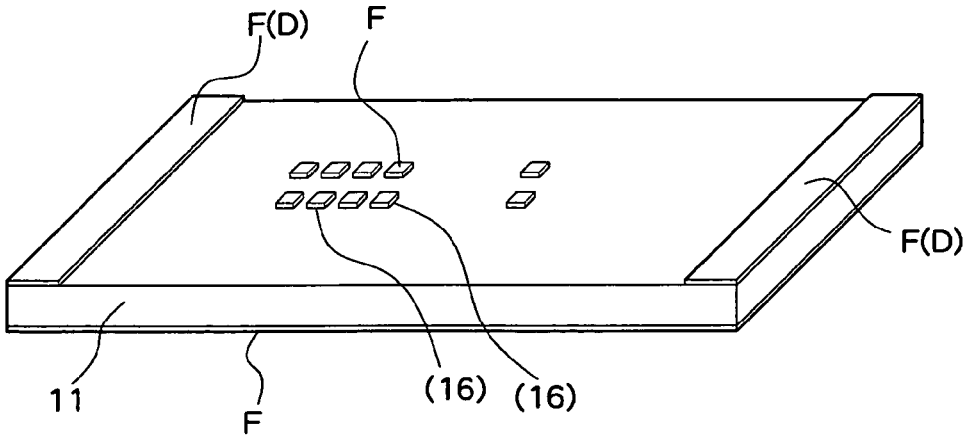
Figure 5G:
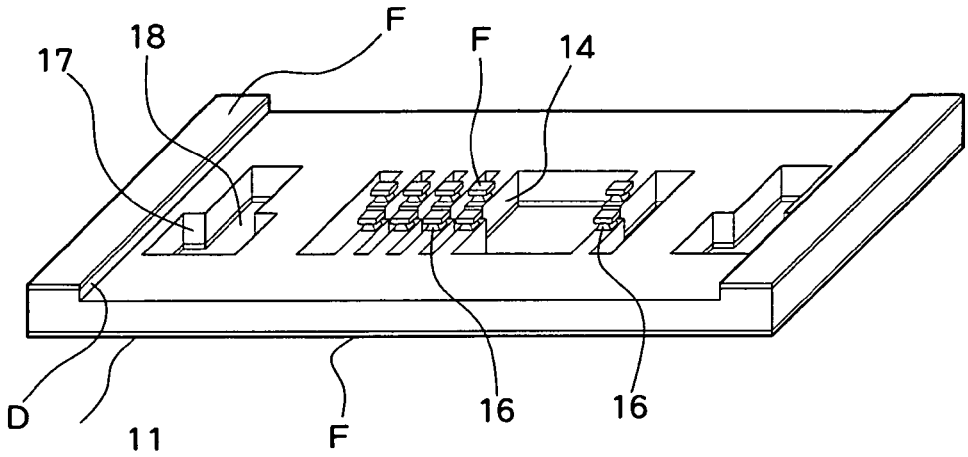

Next, a method of forming the cantilever terminal blocks 14, the guide pin receiving parts 17, and the guide grooves 18 on the board 11 of the socket 10 will be described with reference to FIGS. 5A to 5P. The letters A, B . . . in the following brackets correspond to FIG. 5A, FIG. 5B . . . of the drawings.

(A) Silicon oxide films F are formed by thermal oxidation on both surfaces of the board 11 made of single crystal silicon (thermal oxidation step).

(B) A resist R is applied onto the oxide film F of the one surface, ultraviolet exposure is performed thereon to pattern the contours of the terminal blocks 14, the guide pin receiving parts 17, and the guide grooves 18, and the resist R on those parts is removed to cause the silicon oxide film F to be exposed there (photolithography step).

(C) In accordance with this pattern, the silicon oxide film F other than the masking portion of the resist R is removed by etching to form a patterning mask of the oxide film F (oxide film etching step), and then, the remaining resist R is removed.

(D) Here, a dry anisotropic etching such as DeepRIE, or a wet alkaline anisotropic etching of KOH or the like is performed to hollow out the board 11 in the vertical direction, and the contours of the terminal blocks 14, the guide pin receiving parts 17, and the guide grooves 18 are made to emerge. Incidentally, at this time, the etching is stopped before penetration, and an etching remainder E corresponding to the height t of the stepped part D or the pressure receiving part 16 is made to remain (anisotropic etching step).

(E) Next, the board 11 is reversed to expose the unprocessed surface, a resist R is applied onto the silicon oxide film F, patterning of the stepped parts D and the pressure receiving parts 16 is performed, and a mask of the resist R is formed on the oxide film F (photolithography step).

(F) The oxide film F is etched while this remaining resist R is made the mask, the oxide film F is made to remain only on portions corresponding to the stepped parts D and the pressure receiving parts 16 (oxide film etching step), and subsequently, the remaining resist R is removed.

(G) This board 11 is subjected to isotropic etching of a hydrofluoric acid•nitric acid mixed solution or the like, and the etching remainder E is removed (isotropic etching step).

Figure 5H:
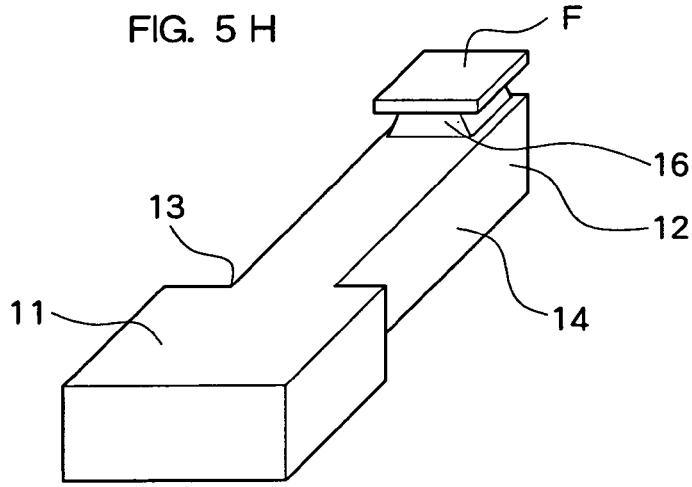

(H) In this way, as shown in the enlarged view of FIG. 5H, by the undercut erosive action of the isotropic etching, the oxide film F as the mask remains and its lower surface is processed to be hollowed out, and the pressure receiving part 16 is formed into an almost square trapezoidal shape.

Figure 5J:
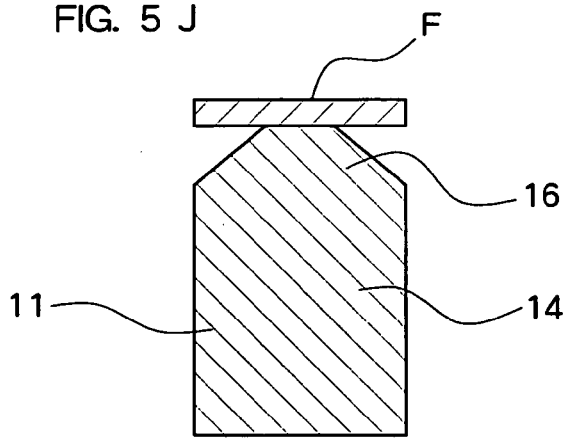
FIGS. 5J and 5P are schematic explanatory views of longitudinal sections, and the others are perspective views.
Figure 5K:
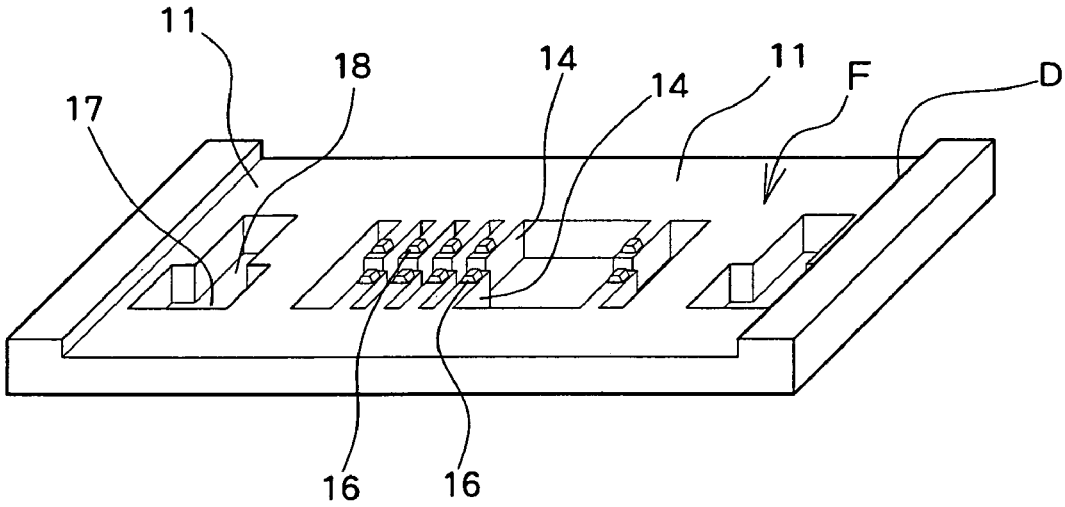
Figure 5L:
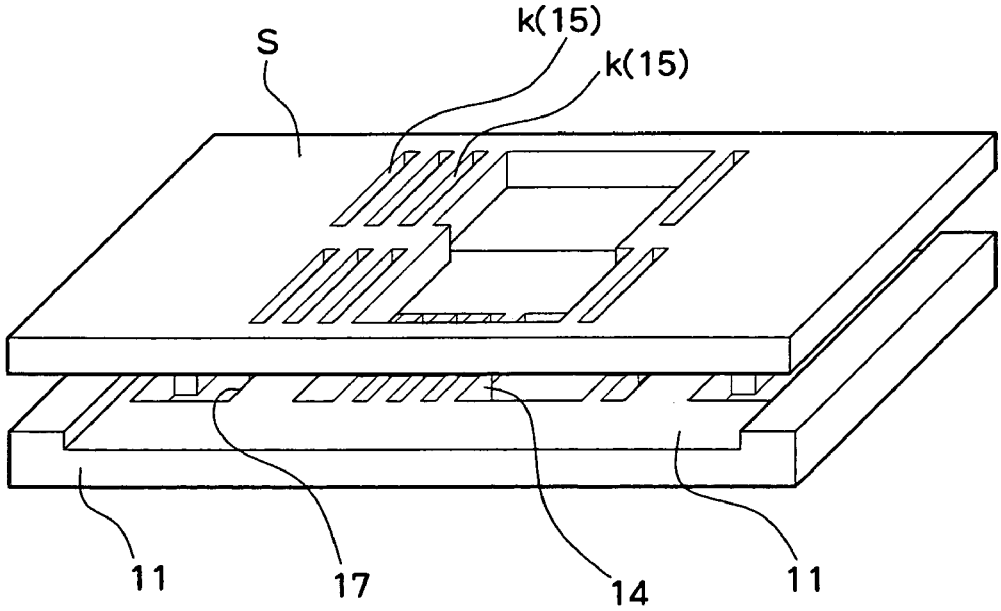
Figure 5M:
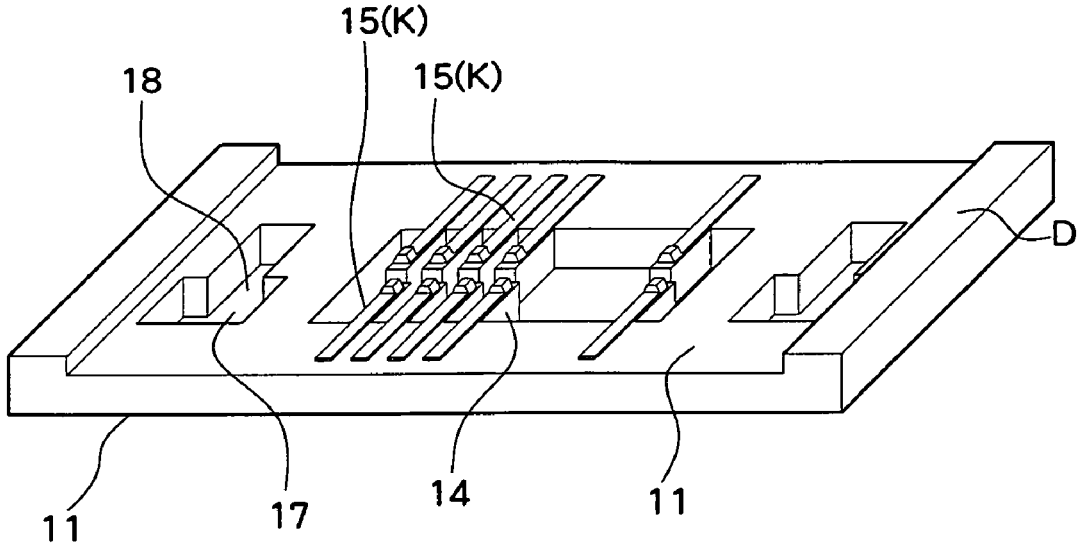
Figure 5P:
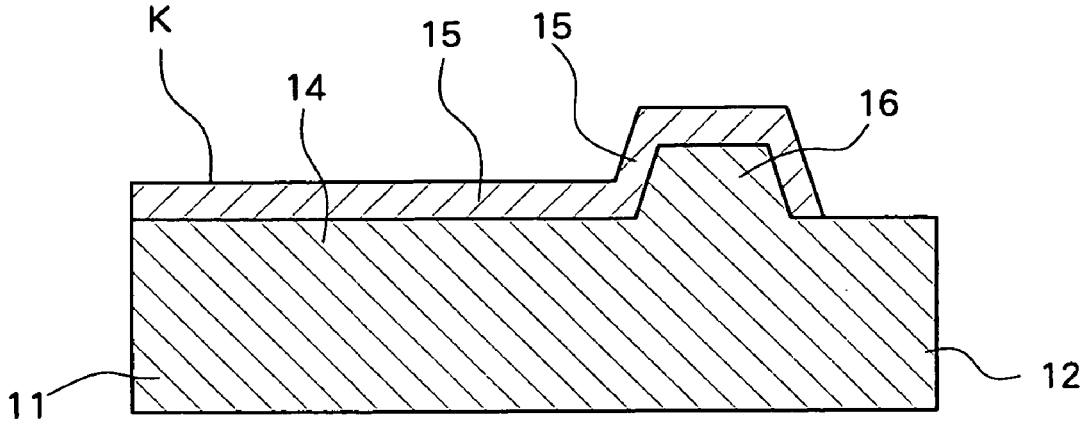
Figure 5R:
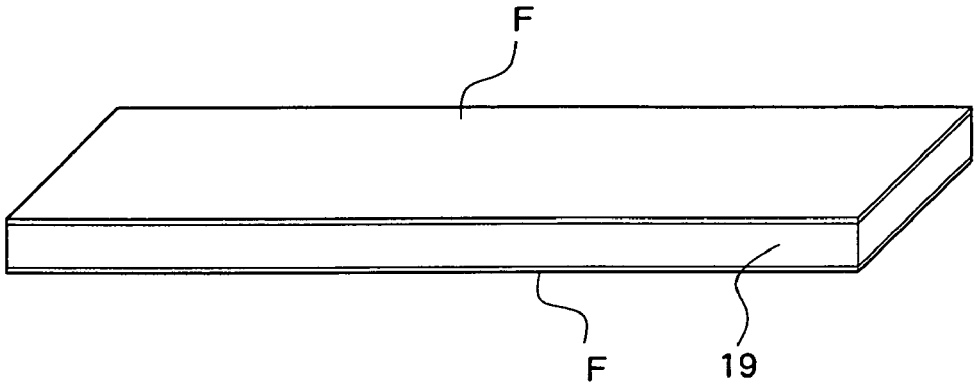
FIGS. 5R to 5U show a manufacturing method of a housing.
Figure 5S:
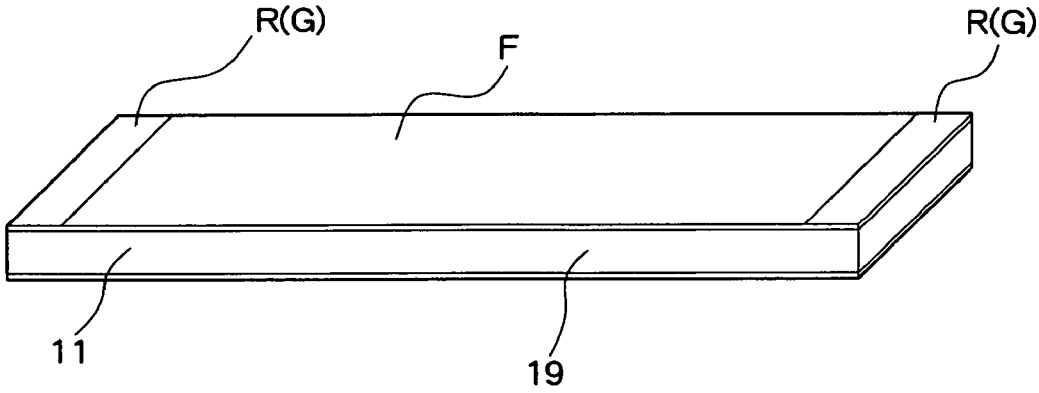
Figure 5T:
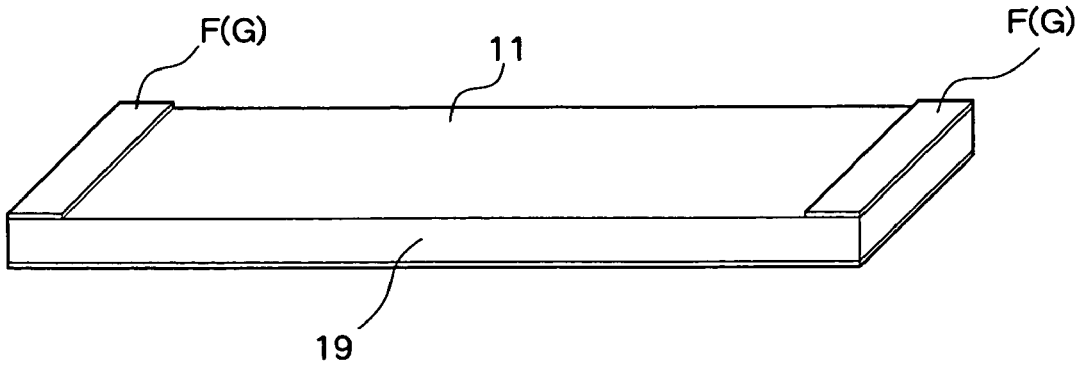
Figure 5U:
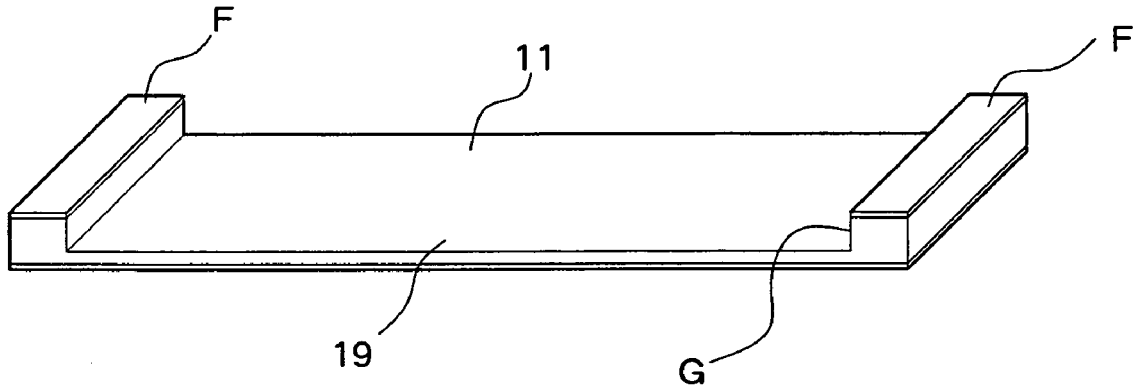
Figure 5V:
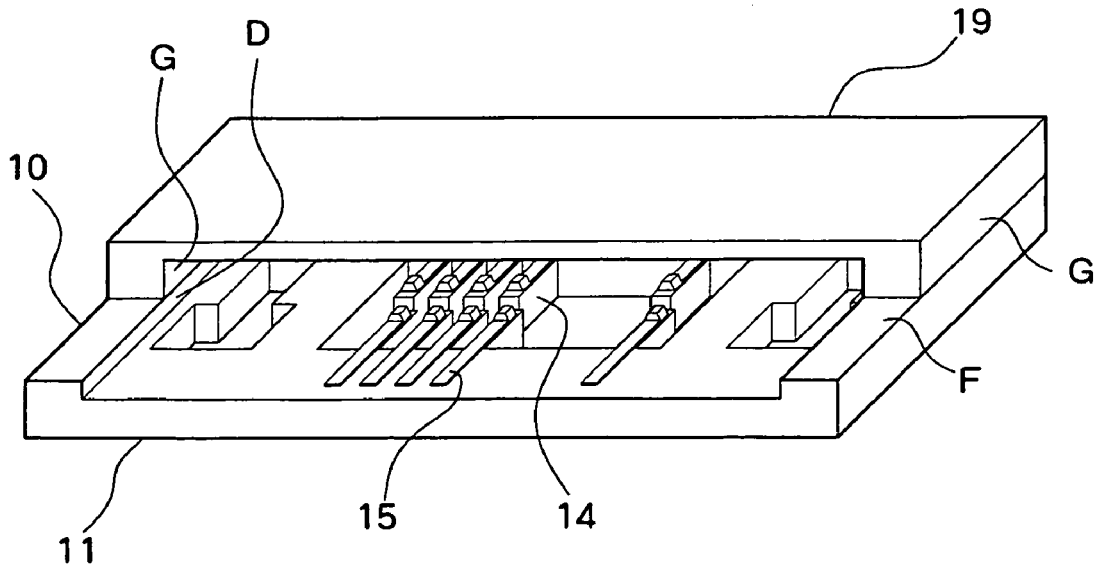

(J) FIG. 5J shows a modeled longitudinal section of the pressure receiving part 16 and shows the oxide film F remaining as the mask, the pressure receiving part 16 formed to be trapezoidal (roof type in sectional shape) as the result of hollowing by the undercut, and the terminal block 14. Incidentally, this remaining oxide film F is removed by the same oxide film etching step as the foregoing (C) before a next step.

(K) Subsequently, a silicon oxide film F is again formed on the whole surface of the silicon board 11 by thermal oxidation to make insulation (thermal oxidation step).

(L) Next, in order to dispose the socket leads 15 on this oxide film F, a shadow mask S in which a pattern k of the socket leads 15 is cut out is mounted on and attached firmly to the board 11, and sputtering is performed, so that metal films of the lead pattern K are formed on the upper surfaces of the terminal blocks 14 and the pressure receiving parts 16 (metallization step).

(M) Since the metal films of the lead pattern K are thin, the thicknesses are increased by plating, and a predetermined thickness is secured (plating step).

(P) As a result, as shown in the modeled longitudinal sectional view of the terminal block 14, a lead pattern K with a predetermined thickness is formed on the terminal block 14 and the pressure receiving part 16, and the lead pattern K is also similarly formed on an inclined surface connecting both smoothly.

FIGS. 5R to 5U show an example of a manufacturing method of the housing 19.

(R) The housing 19 is also made of single crystal silicon, and similarly to the foregoing (A), silicon oxide films F are formed on the surfaces by thermal oxidation (thermal oxidation step).

(S) A resist R is applied thereonto, and synchrotron radiation is further irradiated thereon, so that patterning is performed to form stepped parts G at portions corresponding to the stepped parts D (photolithography step).

(T) In accordance with this pattern, the silicon oxide film F at portions other than those masked by the resist R is removed by etching, and masks of portions corresponding to the stepped parts G are formed by the oxide film F (oxide film etching step).

(U) Here, a dry anisotropic etching such as DeepRIE or a wet alkaline anisotropic etching of KOH or the like is performed, so that the housing 19 is eroded in the vertical direction, the stepped parts G are formed, and the housing 19 is completed (anisotropic etching step).

(V) This housing 19 is turned upside down and is mounted on the board 11 of the socket, and both are bonded by adhesion or other means, so that the socket 10 is completed (bonding step).

In order that the terminal block 14 can be bent by receiving force, "recess" is required in the bending direction, and this can be formed by cutting the back side of the terminal block 14 at the opposite side to the socket lead 15 by etching. As another method, a gap is provided using a relation to the opposite side such as a circuit board to be attached and this "recess" can also be formed.

As described above, according to the above embodiment, since silicon excellent in spring characteristics is used for the board, and the terminal block is made such that the shape of the elastic part of the lead is the cantilever shape, the spring characteristics of the silicon are efficiently used. Since the pressure receiving part is provided and the socket lead is disposed, the elastic contact between the socket lead and the plug lead becomes firm, and the electrical connection between both the leads can be made reliable. Besides, since single crystal silicon is adopted for the board, the fine processing can be precisely and easily performed by efficiently using the micromachining technique. As a result, the microconnector in which the pitch between contact terminals is narrower and whose height is short can be realized.

Further, as the manufacturing method thereof, single crystal silicon is adopted for the board, and the anisotropic etching technique and the isotropic etching technique are skillfully combined and used, so that the fine processing can be precisely and easily performed. Especially, when the pressure receiving part is formed to be trapezoidal to smoothly connect the pressure receiving part and the socket lead, after the board is processed by the anisotropic etching to a predetermined depth in the vertical direction, the isotropic etching is performed to the back side to remove the etching remainder and the trapezoid is formed. Thus, a mechanical processing step such as polishing is removed, and the very delicate fine processing can be provided clean and inexpensively.

INDUSTRIAL APPLICABILITY

As described above, the microconnector of the invention and the manufacturing method of the socket therefor are useful as the connector of an electric equipment which is increasingly required to raise density, to reduce size and to reduce thickness, and as the manufacturing method thereof.

The invention claimed is:

1. A microconnector characterized by comprising:

a socket in which on a board made of single crystal silicon, plural cantilever terminal blocks having free ends with pressure receiving parts in their vicinities and fixed ends continuous with the board are integrally formed, socket leads extending from the fixed ends to the free ends are disposed on upper surfaces of the terminal blocks, a guide pin receiving part and a guide groove continuous with the guide pin receiving part and formed in parallel to the terminal blocks are formed, and a housing covering the free ends and forming a receiving gap part to receive a plug in cooperation with the board is mounted; and the plug in which plug leads corresponding to the socket leads and a guide pin corresponding to the guide groove are provided on a plug board.

2. The microconnector according to claim 1, characterized in that the free ends of the plural cantilever terminal blocks are directed to inside of the board.

3. The microconnector according to claim 1, characterized in that the terminal blocks in which fixed ends are continuous with the board at an insertion side of the plug and the terminal blocks in which fixed ends are continuous with the board at an opposite side thereto are provided, and the pressure receiving parts provided in the vicinities of the free ends are arranged in a staggered manner.

* * * * *